US005960801A

United States Patent [19]

Vermooten et al.

[11] Patent Number: 5,960,801

[45] Date of Patent: Oct. 5, 1999

[54] TOOTHBRUSH ACCESSORY OR ENCLOSURE

[75] Inventors: Carel Arnold Vermooten; Antonie Philippus Lotter, both of Potchefstroom, South Africa

[73] Assignee: Pieter Josua Hendrik Kruger, De Draai Somerset East, South Africa

[21] Appl. No.: 08/889,298

[22] Filed: Jul. 8, 1997

[30] Foreign Application Priority Data

Jul. 8, 1996 [ZA] South Africa ..... 96/5781

[51] Int. Cl.[6] ..... A45D 44/18

[52] U.S. Cl. ..... 132/308; 132/286; 206/209.1; 206/362.3; 422/300

[58] Field of Search ..... 15/184; 206/209.1, 206/362.3, 362.2; 312/206; 422/300, 36; 132/290, 308, 310, 313, 314, 315, 286

[56] References Cited

U.S. PATENT DOCUMENTS

| | | | |
|---|---|---|---|
| 1,041,315 | 10/1912 | Marx | 132/308 |
| 1,194,540 | 8/1916 | Quartararo | 206/209.1 |
| 1,470,129 | 10/1923 | Tichenor | 132/308 |
| 2,043,629 | 6/1936 | Lyon | 206/209.1 |
| 2,576,550 | 11/1951 | Waters | 132/308 |
| 3,127,985 | 4/1964 | Scott | 132/308 |
| 3,746,162 | 7/1973 | Bridges | 15/184 |
| 3,884,635 | 5/1975 | Sloan | 312/206 |
| 4,214,657 | 7/1980 | Winston | 206/209.1 |
| 4,728,504 | 3/1988 | Nochols | 422/300 |

FOREIGN PATENT DOCUMENTS 1210813 11/1970 United Kingdom .

*Primary Examiner*—Gene Mancene
*Assistant Examiner*—Pedro Philogene
*Attorney, Agent, or Firm*—Marshall & Melhorn

[57] ABSTRACT

Disclosed is a tooth brush enclosure which includes a body having a base and a lid which define a cavity dimensioned and shaped to receive a brush portion of the toothbrush. The enclosure also includes a compartment defined within the cavity by a least one of the base and the lid. The compartment is shaped to receive a tablet of sanitizing material. The enclosure further includes a permeable member dimensioned to fit between the compartment and the cavity to allow for gaseous exchange between the cavity and the compartment to sanitize the brush portion of the toothbrush. Furthermore, the enclosure includes a retaining formation defined by an interior surface of the body adjacent the compartment to retain the member in position. Lastly, the enclosure has an aperture defined in at least one of the base and lid through which a handle portion of the toothbrush can extend. The aperture is sized so that the body fits snugly around the handle in an area adjacent the brush portion of the toothbrush to retain the enclosure in position around the brush portion.

7 Claims, 2 Drawing Sheets

TOOTHBRUSH ACCESSORY OR ENCLOSURE

BACKGROUND OF THE INVENTION

THIS invention relates to a toothbrush accessory or enclosure.

It is usual for a toothbrush to be kept and re-used for many months. Because the toothbrush is used to clean the mouth area and because it is often wet or damp, it is an ideal environment for bacterial growth and a toothbrush typically contains large amounts of bacteria and other disease-causing micro-organisms. Also, toothbrushes are often also left open and exposed to the atmosphere and thus to bacteria and other disease-causing micro-organisms present in the atmosphere.

Conventional rinsing of a toothbrush in water is not sufficient to clean the toothbrush properly and bacteria and other disease-causing micro-organisms may grow and accumulate on and in the brush portion of the toothbrush. The bacteria and micro-organisms are then transmitted from there to the mouth of a user each time the brush is used.

SUMMARY OF THE INVENTION

According to the invention a toothbrush enclosure comprises:

- a body having a base and a lid which define a cavity dimensioned and shaped to receive a brush portion of tie toothbrush therein;
- a compartment defined within the cavity by at least one of the base and the lid, the compartment being shaped to receive a tablet of sanitising material there in;
- a permeable member dimensioned to fit between the compartment and the cavity to sallow for gaseous exchange between the cavity and the compartment to sanitize the brush portion of the toothbrush;
- a retaining formation defined on or in an interior surface of the body adjacent the compartment to retain the member in position; and
- an aperture defined in at least one of the base and lid through which a handle portion of the toothbrush can extend, the aperture being sized so that the body fits snugly around the handle in an area adjacent the brash portion of the toothbrush to retain the enclosure in position around the brash portion.

Sanitise, sanitising or sanitary agent as used herein mean any agent which improves the hygiene of the brush portion of a toothbrush wit regard to and infection and may include sterilizing means and sterilising agents, disinfecting means and disinfecting agents, deodorising means and deodorizing agents, odourising means and odourising agents, antiseptic means and antiseptic agents, germicides aid antibacterial means and antibacterial agents.

The permeable member may be a perforated cover plate which spans the base anti which has inwardly angled edges which engage the retaining formation.

The retaining formation may be a ridge or a groove defined on or in the interior surface of at least two opposed sides of the base.

The compartment is preferably integrally formed with the body and preferably comprises an upstanding side wall extending from the base, the compartment being positioned so that the tablet of sanitising material is positioned beneath the brush portion of the toothbrush when it is received within the cavity.

The compartment may be hemispherical.

The enclosure preferably also includes a hinge between the base and the lid, the hinge being formed integrally with the base and the lid.

The hinge may be a snap-type hinge.

The sanitising means may be a solid tablet or a capsule containing sanitising material.

The sanitising material may comprise, separately or in combination, thymol, chlorocresol, glutaraldehyde and phenol.

The sanitising material may also comprise any approved carrier or excipient, such as dicalcium phosphate.

The body is preferably made of a polymerize material. The polymeric material is preferably a plastics material or a resinous material. More preferably, the polymeric material is a plastics material selected from polypropylene and high density polyethylene. It may be moulded from the polymeric material, for example, by injection moulding.

The polymeric material may have an odourising or deodorising material incorporated therein during formulation.

According to another aspect of the invention a toothbrush sanitising material comprises a tablet containing thymol and a carrier.

The carrier may be dicalcium phosphate.

The tablet may contain about 250 mg of thymol.

According to another aspect of the invention a method of sanitising a toothbrush comprises placing it in a toothbrush enclosure of the invention for a period of time.

BRIEF DESCRIPTION OF THE DRAWINGS

The invention will now be described in more detail, by way of example only, with reference to the accompanying draftings in which.

DETAILED DESCRIPTION OF THE INVENTION

Figure 1:
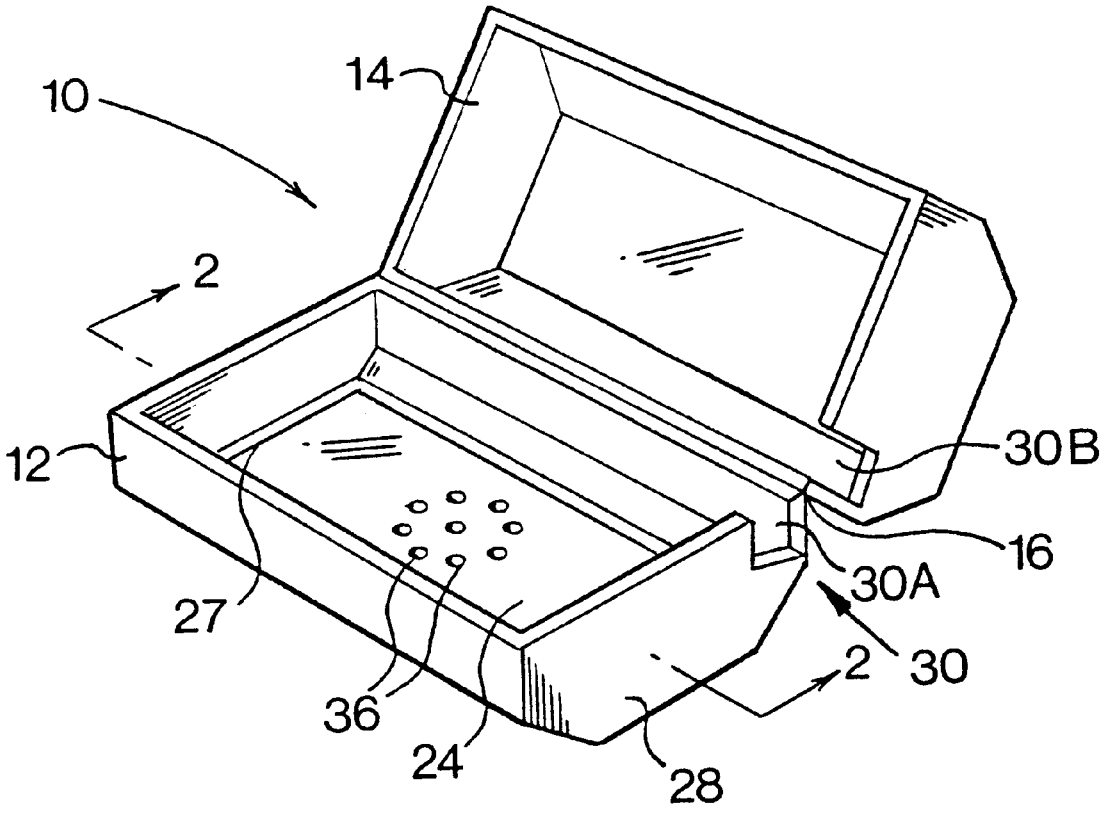
FIG. 1 is a pictorial view of a toothbrush accessory of the invention in an open configuration.

The toothbrush accessory or enclosure of the invention, generally designated 10 in the attached figures, comprises a body defining a base 12 and a lid 14, hinged to one another by means of an integrally formed resilient snap-type hinge 16. Together, the base 12 and the lid 14 form a generally rectangular and box-shaped enclosure 10 defining an internal cavity and having top and bottom sides and endwalls 28. The cavity is shaped and dimensioned to receive and contain the brush portion of a toothbrush within it with sufficient space around the bristles so that air can circulate around them and so that the bristles of the brush do not come into contact with an interior surface of the body. The enclosure does, however, fit snugly around the brush portion of the toothbrush and is thus small and easily transportable. Because the cavity is dimensioned to receive only a single toothbrush, it can be effectively sanitised in a relatively short period of time by the sanitising means (described more fully below). This is the case even if the toothbrush is removed from and replaced within the enclosure a number of times in a day.

The base 12 and lid 14 are integrally moulded from a polymeric plastics material, which may be polypropylene or high density polyethylene, and each has a wall thickness of about 1 mm. They are mirror images of one another and form a bottom half and top half respectively of the enclosure 10. The resilient hinge 16 runs alongside two adjoining surfaces of the base 12 and lid 14 and biases their unhinged surfaces towards one another to close the enclosure 10 and to maintain the enclosure 10 in a closed configuration. Thus, by gripping the body anti applying a slight pressure against the resilient hinge, the enclosure 10 can be snapped open and by forcing the base and lid towards one another the enclosure 10 can be snapped shut.

Figure 2:
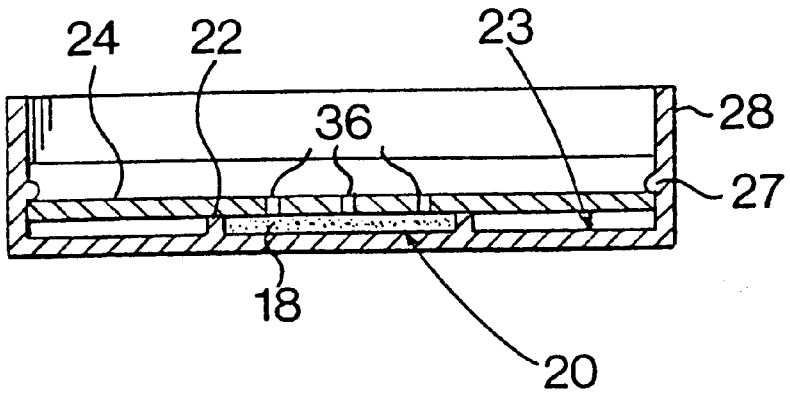
FIG. 2 is a sectional side view on 2—2 through the toothbrush accessory of FIG. 1.
Figure 4:
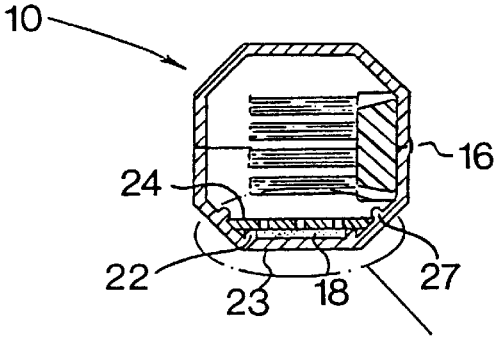
FIG. 4 is a sectional side view on 4—4 through the toothbrush accessory of FIG. 3 but in a closed configuration.

Contained within the enclosure is suitable sanitising means. The sanitising means contains a sanitising material which mart be a disinfectant material, and optionally also an odourising material, for disinfecting the brush portion of the toothbrush. The sanitising material is contained within a compressed solid tablet 18 held within a compartment 20 formed integrally in the base 12 as shown in FIGS. 2 and 4. The compartment 20 is sized so that the tablet 19 fits snugly into it. The tablet 18 will therefore be just slightly smaller than the compartment 20. This ensures that the tablet 18 is held in position and does not move around within the compartment, which movement may result in breaking or flaking of the tablet with the movement of the toothbrush.

The compartment 20 which is approximately 1.5 mm high and has a diameter of approximately 5 mm, is formed by an upstanding rigid side wall 22 formed integrally with the bottom surface, 23 of the base 12. It is positioned so that when a toothbrush is received within the body, the tablet 18 is situated beneath and substantially in the middle of the brush portion. This ensures that there is optimum dispersal of the sanitizing material through the bristles. The space between the tablet and the closest bristles is sufficient to allow for an efficient circulation of the sublimated sanitising material around the entire brush portion.

Figure 5:
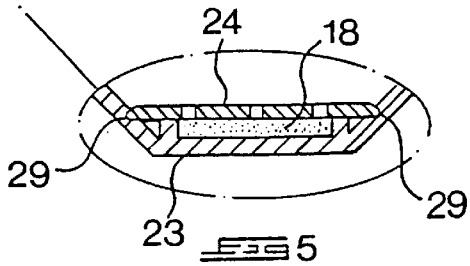
FIG. 5 is a sectional side view on a toothbrush accessory of the invention with an alternative form of cover plate.

A cover plate 24, which has a shape corresponding to that of the interior of the base 12, fits over the compartment 20. It is retained in position by fitting under an outwardly extending rounded retaining ridge 27, which is formed integrally with the walls of the base 12. The ridge is shaped and dimensioned so that it is easy to fit the cover plate 24 in position over the compartment 20 during assembly of the enclosure 10 by pushing the edges of the cover plate 24 over the ridge but so that the cover plate is also held firmly in position during subsequent use of the enclosure. The cover plate 24 can alternatively be held in position by fitting into a groove 29 formed in the walls of the base as shown in FIG. 5. The cover plate 24 spans the base 12 so that it cannot easily be dislodged during use which may lead to breakage or loss of the tableted sanitising material.

The corners of the enclosure 10 are cut off so that it is an octagonal structure. This streamlines it and makes it easier to fit into restricted spaces for transport.

The edges of the cover plate 24, as can be seen in FIG. 4, can be angled inwardly to ensure chat it fits snugly against the correspondingly angled sides of the base 12 and underneath the ridge 27 and is not easily removable. The edges of the cover plate 24, as can be seen from FIG. 5, can also be rounded outwardly to ensure that it fits snugly into the groove 29 and is not easily removable. The cover plate 24 has numerous perforations 36 defined in it, each having a diameter of approximately 0.55 mm, to allow the sanitising material contained within the tablet 18 to permeate; into and flow around the entire interior of the enclosure. Although the tablet is well compressed and shield not flake or disintegrate, the perforations in the cover plate 24 are size to ensure that if any such flaking does occur, the flakes will be trapped by the cover plate 24 and kept away from the bristles of the toothbrush.

Figure 3:
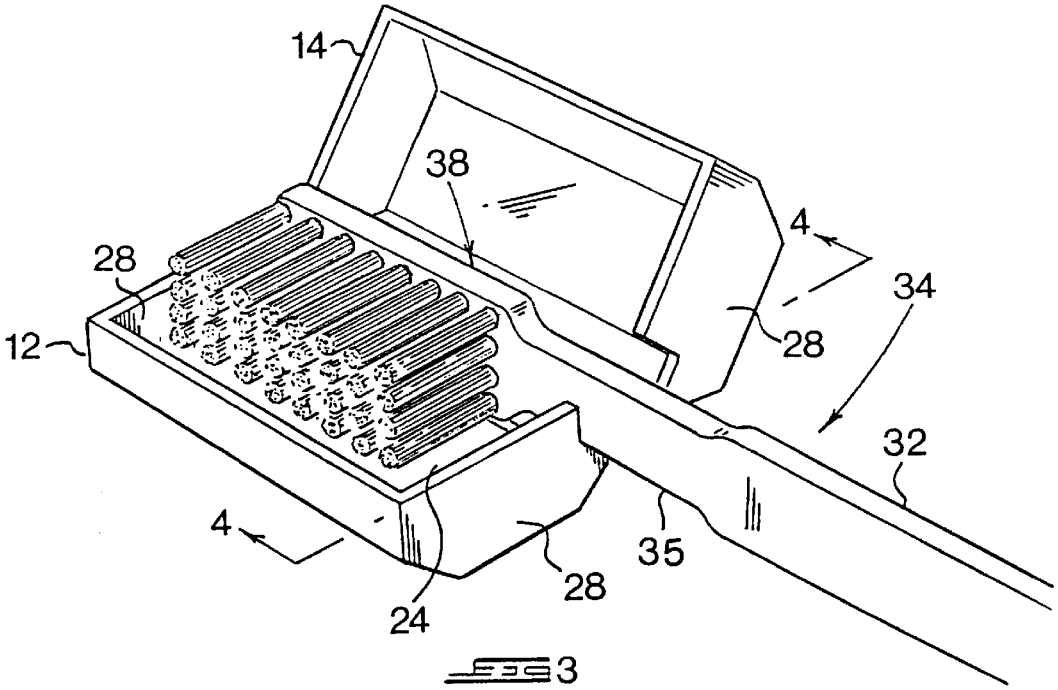
FIG. 3 is a pictorial view of a toothbrush accessory of the invention in an open configuration and with a toothbrush received therein.

At one end of the enclosure 10 an opening 30 is defined through which the neck portion 36 of the handle or shaft 32 of a toothbrush 34 can extend when the toothbrush 34 is received within the enclosure, as shown in FIG. 3. The opening 30 is formed partly by a cutaway section 30*a* formed in the base 12 and partly by a cutaway section 30*b* formed in the lid 14. The cutaways 30*a* and 30*b* are dimensioned so that the surrounding endwall 28 fits snugly around the neck 36 of the toothbrush in an area just below the brush portion. When the enclosure 10 is closed, the brush portion is therefore held securely within the enclosure 10 without the bristles coming into contact with the cover plate 24 yet with the tablet positioned just under them and with sufficient space around the bristles as seen in FIG. 4. The back 38 of the brush portion is positioned against a side of the enclosure so that the brush is held firmly within the enclosure and does not move around within it.

The sanitising material contains any one or more of a number of suitable active vapourisable disinfectant or antiseptic chemicals, including thymol, chlorocresol, glutaraldehyde and phenol admixed with a suitable carrier or carriers or excipient or excipients and compressed into the tablet 18. The sanitising material may comprise a combination of these disinfectant chemicals in addition to an odourising or deodorising material or other antiseptic or antibacterial means. The chemicals should be capable of vapourising or sublimating to disinfect the bristles. The vapourised chemical will come into contact with the brush portion of the toothbrush and flow between the bristles to kill bacteria or other disease causing or microorganisms which may be present.

The amount of active material may vary but in all cases it must be sufficient to cleanse and sterilise the brush portion and to have an active life of approximately three months. The effective amount may be determined by routine experimentation. Typically, a tablet contains 50% by weight of vapourisable disinfectant materials and 50% by weight of a carrier Thymol, which is in the form of colourless crystals, is a phenolic antiseptic with both antibacterial and anti-fungal properties. It has been used in a variety of oral and dental products. In a preferred tablet of the invention, thymol is mixed directly with the compressible inactive excipient dicalcium phosphate. The tablet typically contains approximately 200 to 250 mg of thymol and the same amount of dicalcium phosphate and will remain effective in inhibiting the growth of the most common oral bacteria for periods of three months and longer. A tablet of the invention may contain up to 1 g of thymol and up to 1 g of dicalcium phosphate.

The most important micro-organisms causing tooth decay in the mouth are:

1. *Streptococcus mutans;*
2. *Streptococcus sorbrinus;* and
3. *Lictobacillus caseii.*

The most important micro-organisms causing periodontal gum disease in the mouth are:

1. *Actinobacillus actinomycetemcomitens;*
2. *Porphyromonas gingivalis;* and
3. *Prevotella intermedia.*

Tests were conducted on:

i. uncovered toothbrushes from volunteers in the middle to upper economic classes with an age variation of from 4 to 75 years, none of whom had a full set of dentures although some had partial dentures; and ii. clean control brushes which had not been used.

Within 2 to 12 hours after use, the brush portion of each of the used toothbrushes was incubated in a Tryptone soya broth for 12 hours. After this, the broth was transferred onto standard growth media for further microbiological culture and identification. The rest yielded the following results:

| Clean brushes (No growth) | Used brushes *E. faecalis* | Used brushes Streptococcus Group B & D | Used brushes *Lactobacillus caseii* | Used brushes Other |
|---|---|---|---|---|
| 0% | 25% | 35% | 30% | 10% |

Thus, the three micro-organisms most important in causing tooth decay occurred on the toothbrushes. The finding of the *Enterococcus faecalis* bacteria was unexpected as this organism normally occurs in human faeces but not in the mouth. It was found that this bacterium occurred on toothbrushes which were stored in bathrooms which had a flushing toilet with the wet toothbrushes acting as a good growth medium for the bacteria released into the air on flushing of the toilet.

Clinical trials were run to test the efficacy of the preferred sanitising material of the invention, thymol dicalcium: phosphate, on standard cultures of bacteria known to be found on toothbrushes and on cultures derived from toothbrushes obtained from participants in the trials.

The following standard cultures were used:

*Enterococcus faecalis:* obtained from the Medical Research Council (RSA)

Type culture NCTC 775 (United Kingdom)

Streptococcus mutans: obtained from the University of Pretoria

Type culture ATCC 25175 (USA)

*Lactobaccillus caseii:* obtained from the University of Pretoria Type culture ATCC 393 (USA).

The following trials were run:

(A) In nitro (i) Closed containers

A tablet of thymol-dicalcium phosphate was placed in a small closed airtight glass container, sealed off by a cork. Earbuds impregnated with the different cultures were suspended in the container from the cork. Sublimated thymol circulated in the container.

Result: Varying strengths of thymol (10%; 25% and 50%) were equally effective, as no growth of any organism would be demonstrated after 12 hours.

(ii) Enclosures of the invention

A tablet of 50% thymol-dicalcium phosphate: was placed in an enclosure of the invention, and earbuds contaminated with the three organisms were placed in the same receptacle after 30, 60 and 90 days. Result: Again no growth could be obtained from any micro-organism after being exposed to sublimated thymol for 12 hours.

The chemical substance was equally effective at 30, 60 and 90 days (in vitro).

(B) In vivo:

Detailed information (in writing) about the product being tested was given to each participant before the trial.

Toothbrushes currently being used were obtained, These were incubated, and the micro-organisms from each person were ascertained. A new toothbrush and toothbrush enclosure with 50% thymol-dicalcium phosphate was now given to each participant. They had to brush their teeth twice a day (as usual), and had to replace the brush in the enclosure after each use.

One third of the brushes were taken in after 30 days, still within the container. After being exposed to the sublimated thymol for 12 hours after last being used, the brushes were incubated and similarly examined. The results obtained were compared to the cultures from each person's untreated toothbrush. After 60 and 90 days the next brushes were taken in, and similarly examined.

The results are shown below.

| | Toothbrush (never kept in enclosure) Amount of bacteria present | Toothbrush kept in enclosure for 30 days after brushing teeth (% inhibition) | Toothbrush kept in enclosure for 60 days after brushing teeth (% inhibition) | Toothbrush kept in enclosure for 90 days after brushing teeth (% inhibition) |
|---|---|---|---|---|
| *E. faecalis* | 25% | 85% | 75% | 30% |
| *Strept. mutans* | 35% | 85% | 78% | 40% |
| *Lact. caseii* | 30% | 90% | 79% | 37% |

The tablets used in these trials contained less than 130 mg of thymol. Thus, a tablet containing 250 mg of thymol will be effective for a longer period.

The toothbrush accessory or enclosure of the invention may be sold alone, covered in a suitable protective air and liquid tight wrapping, or may be sold as a complete unit with a new toothbrush. The sanitising chemicals contained within tie carrier typically retain their activity for about three months from the date of opening the protective plastics wrapping within which it is contained for sale. Thus, after three months the receptacle should be discarded and replaced with a new one. This is in accordance with prudent dental hygiene which holds that toothbrushes should be changed at intervals of three months. Thus, the receptacle can be discarded with the toothbrush. The integrally formed hinge is specifically designed to have a limited operative life. Thus, the failure of the hinge will ensure that the receptacle is replaced.

The toothbrush accessory of the invention, is easy and cheap to manufacture. It is also easy and convenient to use, being light and easily transportable and easily replaceable. It also provides a simple method for sanitising a brush portion of a toothbrush. It should thus markedly improve oral hygiene.

We claim:

1. A toothbrush enclosure comprising:

a body having a base and a lid which define a cavity dimensioned and shaped to receive a brush portion of the toothbrush therein, a compartments defined within the cavity by at least one of the base and the lid, the compartment being shaped to receive a tablet of sanitising material therein;

a permeable member dimensioned to fit between the compartment and the cavity to allow for gaseous exchange between the cavity and the compartment to sanitise the brush portion of the toothbrush;

a retaining formation defined on or in an interior surface of the body adjacent the compartment to retain the member in position; and an aperture defined in at least one of the base and lid through which a handle portion of the toothbrush can extend, the aperture being sized so that the body fits snugly around the handle in an area adjacent the brush portion of the toothbrush to retain the enclosure in position around the brush portion.

2. A toothbrush enclosure according to claim 1, wherein the permeable member is a perforated cover plate which spans the base and which has inwardly angled edges; which engage the retaining formation.

3. A toothbrush enclosure according to claim 1, wherein the retaining formation is one of a ridge defined on the interior surface of at least two opposed sides of the base.

4. A toothbrush enclosure according to claim 1, wherein the compartment is defined by an upstanding side wall on the base, the compartment being positioned so that the tablet of sanitizing material is positioned beneath the brush portion of the toothbrush when the brush portion of the toothbrush is received within the cavity.

5. A toothbrush enclosure according to claim 1, wherein the body includes a hinge between the base aid the lid, the hinge being formed integrally with the base and the lid.

6. A toothbrush enclosure according to claim 1, including a tablet of sanitizing material sized to be received within the compartment, wherein the tablet of sanitizing material comprises a material selected from the group consisting of thymol, chlorocresol, glutaraldehyde and phenol or mixtures thereof, and a suitable carrier or excipient.

7. A toothbrush enclosure according to claim 6, wherein the tablet comprises about 250 mg of thymol and about 250 mg of dicalcium phosphate.

* * * * *